United States Patent [19]

Fetty et al.

[11] 4,193,517

[45] Mar. 18, 1980

[54] WATER SQUIRT CANE HAVING MOVABLE FIGURE AS ACTIVATOR

[75] Inventors: Warren N. Fetty; Rosabelle Fetty, both of Altadena, Calif.

[73] Assignee: Wham-O Mfg. Co., San Gabriel, Calif.

[21] Appl. No.: 830,840

[22] Filed: Sep. 6, 1977

[51] Int. Cl.[2] ..... B05B 17/00

[52] U.S. Cl. ..... 222/78; 222/174; 222/478

[58] Field of Search ..... 222/78, 174, 182, 321, 222/383, 385, 478, 402.13; 272/15

[56] References Cited

U.S. PATENT DOCUMENTS

| | | | |
|---|---|---|---|
| 2,379,160 | 6/1945 | Kennison | 222/321 X |
| 2,385,091 | 9/1945 | Lukowitz | 222/78 X |
| 2,508,104 | 5/1950 | Pickensheets | 222/174 X |
| 2,998,165 | 8/1961 | Elorza | 222/402.13 X |
| 3,062,416 | 11/1962 | Cooprider | 222/321 |
| 3,163,330 | 12/1964 | Ryan | 222/383 X |
| 3,596,808 | 8/1971 | Corsette | 222/321 |
| 3,684,195 | 8/1972 | Bret et al. | 222/385 X |

*Primary Examiner*—David A. Scherbel
*Attorney, Agent, or Firm*—Christie, Parker & Hale

[57] ABSTRACT

A large capacity water squirting implement in the form of a cane. This water squirting implement utilizes a reciprocal plunger hand pump which is mounted at the top of a hollow, elongated tube which provides the large water storage capacity. A head is slidably secured to the top of the cane, enclosing the pump in such a way that reciprocal motion of the head is transmitted to the plunger of the pump to cause squirts of water to be emitted from a tube extending from the outlet of the pump to the exterior of the head.

12 Claims, 3 Drawing Figures

WATER SQUIRT CANE HAVING MOVABLE FIGURE AS ACTIVATOR

BACKGROUND OF THE INVENTION

The present invention relates to water squirt toys, and in particular, to a large capacity water-squirting cane having the operating mechanism and the water outlet located at the top of the cane.

Squirt guns and other mechanisms for squirting short bursts or jets of water have been popular playthings for many years. Such mechanisms have taken many forms and included in such forms are toys such as water squirt canes. Representative of squirt canes are the canes shown in U.S. Pat. Nos. 2,385,091; 2,438,014; and 2,508,104. The squirt canes in these prior art examples are cumbersome and difficult to operate and depend upon the strength of the user or his manual dexterity in order to obtain a satisfactory burst of water emitted from the squirt cane outlet.

Thus,in two of the three instances in the prior art referred to above, the pump is a squeeze bulb located at the top of the cane. In the third, the pump is located at the base of the cane and is operated by a pull-string or a pullwire. In all three cases, the outlet nozzle is located at the base end of the cane, limiting the use of the cane to practical joke and trick applications and restricting its range significantly.

SUMMARY OF THE PRESENT INVENTION

In contrast, the present invention provides a water squirt cane in which the pump and the squirt outlet are located at the top of the cane. In its presently preferred embodiment, the cane of the present invention utilizes a reciprocal plunger hand pump which is operated by exerting downward pressure on a figure head enclosing the pump while resting the cane on the ground. The use of reciprocal pumping motion eliminates the need for dexterity and strength since the user has only to lean on or exert weight on the head of the cane to cause the head to be depressed, thereby operating the reciprocal plunger pump and causing a burst of water to be emitted from the outlet nozzle.

Thus, the present invention provides a water squirt cane comprising an elongated, hollow shaft and a pump, having an inlet and an outlet, mounted at the top of the shaft. Means for filling the interior of the shaft with water are provided and conduit means communicate between the hollow interior of the shaft and the inlet to the pump. Aperture means are provided, communicating with the pump outlet whereby hand operations of the pump cause intermittent squirts of water to be emitted from the cane.

The advantage of the present invention is that a water squirt toy with an outlet in the head of the cane and a very large capacity (the entire hollow volume of the cane) is provided. In addition, the toy has a range comparable to or greater than that available with any other type of water squirt toy. The range of the bursts of water emitted by the water squirt toy according to the present invention is up to twenty feet when the head is operated with a firm, swift, downward stroke of the cane head.

DESCRIPTION OF THE DRAWINGS

These and other advantages of the present invention will be better understood by reference to the figures of the drawing wherein.

DESCRIPTION OF THE SPECIFIC EMBODIMENT

Figure 1:
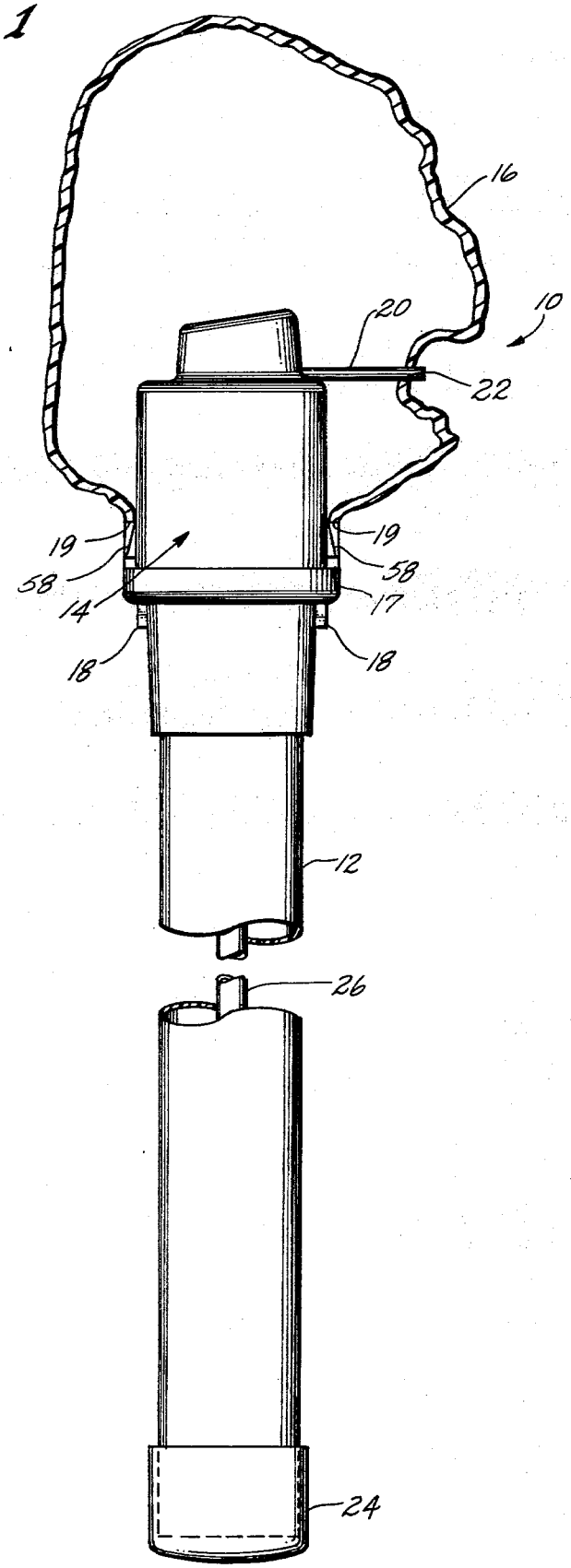
FIG. 1 is a side elevational view, partially in section, of the water squirt toy according to the present invention.

A water squirt toy or squirt cane 10 according to the present invention is shown in FIG. 1. As shown therein, the cane comprises an enlongated hollow shaft or tube 12, an adapter assembly 14 mounted at the upper end of tube 12, and a head 16 mounted on top of the cane, enclosing and being secured to the adapter assembly by means of apertures 19 located in the neck of head 16 which register and interlock with inclined bosses 58 on the exterior surface of adapter assembly. The head may be further secured to the adapter assembly by means of adhesives. A semi-rigid, narrow diameter fube 29 extends between an outlet from a reciprocal plunger hand pump 28 (see FIG. 3) through an aperture in adapter assembly and through a second aperture 22 in the head to the exterior of the cane. In the presently preferred embodiment of the invention, head 16 is in the form of the head of an animal, such as an ape. Other embodiments of the head are also contemplated, such as human faces, birds, reptiles and the like. The head 16 is configured such that aperture 22 is located in the mouth of the ape.

At the bottom end of squirt cane, cap 24 is frictionfitted to the open end of tube 12. Cap 24 is removable to allow filling of the cane. During filling, the cane is inverted and water poured into the hollow interior of shaft 12 until the desired quantity has been added. Thereafter, the cap is replaced and the cane is reinverted and ready for squirting use. In a second embodiment shown in FIG. 2, a filling aperture 25 is provided in the shaft below the adapter assembly. A removable plug 27 provides the means for sealing the aperture and retaining the water supply in the cane. A T-shaped extension 29 formed integrally with plug 27 extends into the interior of shaft 12 and retains the plug in operative relationship with the cane during filling.

A conduit 26 extends from the inlet to the reciprocal plunger pump (see FIG. 2) along the length of tube 12 to the base of the cane and provides the means whereby the water supply ia drawn from the reservoir of the hollow tube to the pump itself preparatory to being expelled through tube 22 as a burst or squirt of water.

Figure 2:
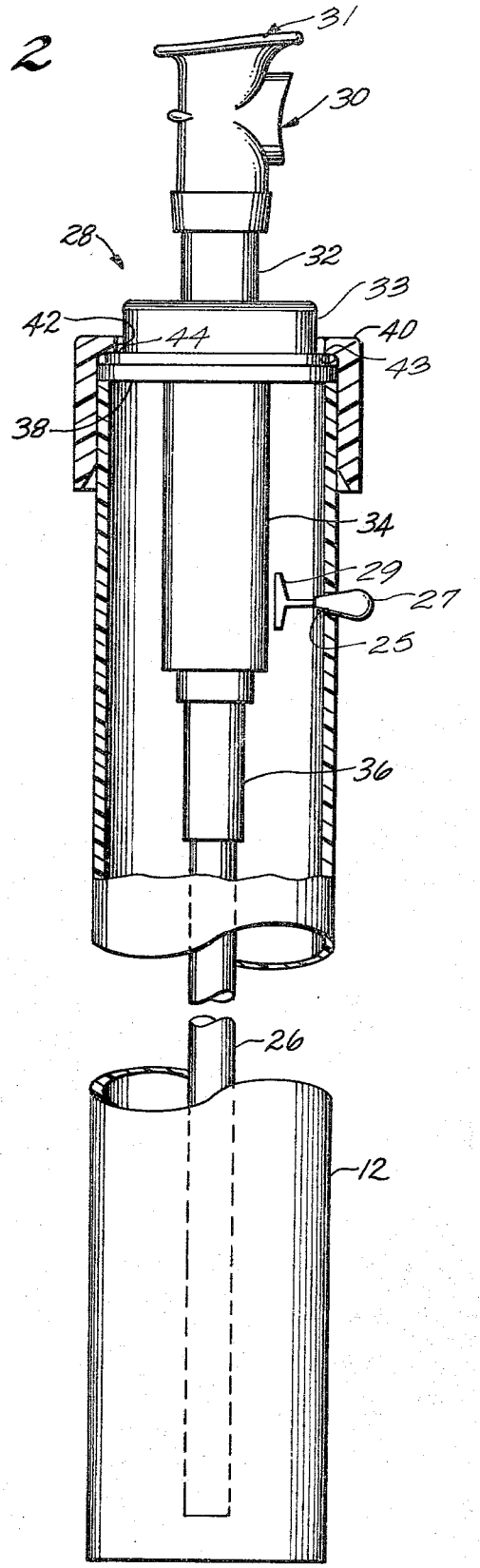
FIG. 2 is a side elevational view, partially in section, of the pump-shaft assembly of the present invention.

A reciprocal plunger hand pump 28 is shown in FIG. 2 at the top of the cane with the head and the adapter assembly shown in FIG. 1 removed. As shown therein, pump 28 comprises a pump operating lever 31, a spray head 30 incorporated into lever 31, a shaft 32 extending downwardly into an accumulator 34 and an inlet 36 located on the side of the accumulator 34 opposite the spray head. The connection of conduit 26 to inlet 36 of the pump is shown in the partially sectioned view in FIG. 2 as is the hollow interior of tube 12. As seen from FIG. 2, pump assembly 28 is seated by means of a washer 38 at the top of tube 12 and is held in position thereby by means of a retainer cap 40 having a central aperture 42 in the cap or top portion thereof large enough to permit cap 40 to be placed on top of tube 12 with spray head 30 and the top portion 33 of accumulator 34 passing therethrough. A shoulder 43 defined by aperture 42 overlaps and rests upon shoulder 44 formed at the base of top portion 33 to retain pump 28 in position on top of washer 38. Retainer cap 40 is bonded to the exterior of tube 12 to hold itself and pump 28 in position at the end of tube 12. The secured or clinched relation of washer 38, upper portion 33 and retainer 40 seal the top of the tube 12 and prevent water from leaking past the washer into the hollow interior of head 16 even when the cane is inverted.

Figure 3:
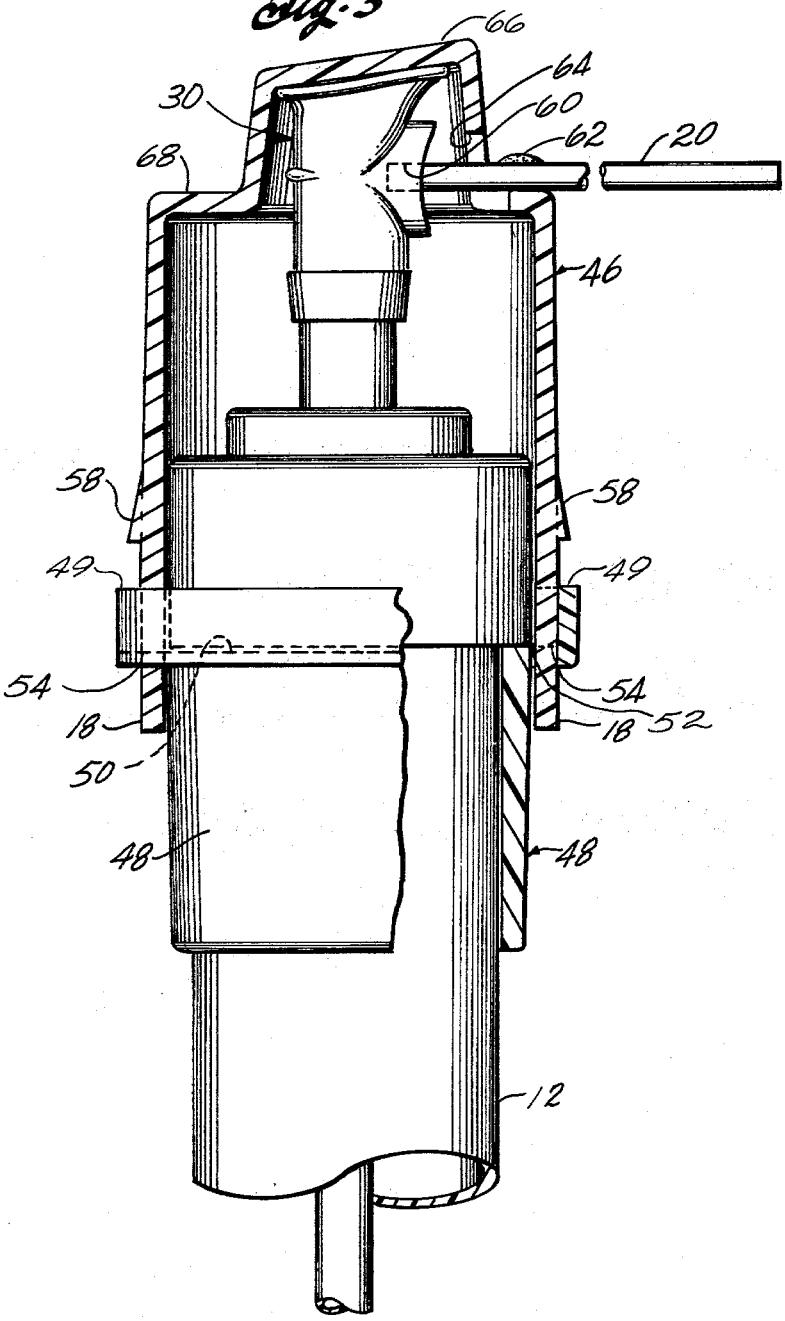
FIG. 3 is a detail view of the pump and shaft assembly of FIG. 2 with an adapter shown in section, mounted over and enclosing the pump and the top of the shaft.

Surrounding pump 28 and retainer 40 is adapter assembly 14 comprising a top portion 46 and a bottom portion 48 as shown in FIG. 3. Bottom portion 48 is a sleeve having a diameter such that the tube 12 passes through the cylinder defined by the sleeve. Bottom portion 48 is open at each end and is enlarged and counter-sunk at its upper end to define a shelf 50 for receiving base 52 of top portion 46. Shelf 50 is perforated at 54 to receive tabs 18 extending downwardly from top portion 46 is registration with apertures 54. Once top portion 46 is positioned on pump 28, tabs 18 are heat-staked to lock bottom portion 48 of the adapter assembly to it.

Top portion 46 is a clyinder open at base 52 and closed at the end opposite thereof. The closed end is counter-sunk in a configuration adapted to receive and seat against pump operating lever 31 of pump 28. In final assembly, the adapter assembly portions 46, 48 rest upon and are supported by operating lever 31 of the pump. A pair of bosses 58, which appear wedgeshaped in cross section, are formed into the exterior surface of top portion 46. In the present embodiment, bosses 58 are circular in configuration and are inclined in a direction extending away from the top of top portion 46. When head 16 is placed over the top portion of the adapter assembly, the apertures 19 provided in the neck of the head 16 are located to receive and register with bosses 58 to lock the head in position on top of the adapter assembly with the base 17 of head 16 resting upon the circular surface 49 defined by the top of lower portion 48 of the adapter assembly. To more fully lock the head in position, the head is adhesively secured to top portion 46.

In assembly of the apparatus, straw or tube 20 is inserted through aperture 64 in top portion 46 into an aperture 60 at the outlet of spray head 30. Tube 20 rests on a shoulder 68 defined by the counter-sunk section of adapter top portion 46 and is further secured in position by means of hot melt adhesive 62 which is deposited on the tube 20 at a point exteriorly of aperture 64 to secure tube 20 to shoulder 68.

During assembly, tube 20 is relatively long. Head 16 is placed on the assembly by first guiding tube 20 into the interior of head 16 and threading it through aperture 22. Head 16 is then placed over the adapter assembly while at the same time an additional portion of tube 20 is being fed through aperture 22 until the head is locked on bosses 58 and seated on surface 49, leaving a significant length of tube 20 extending exteriorly of the head. Once every element is positioned, tube 20 is cut such that only a small increment such as is shown in FIG. 1 is left extending exteriorly of aperture 22.

What is claimed is:

1. A hand operated water squirt cane comprising:

an elongated hollow shaft;

a reciprocal plunger pump mounted at the top of the shaft, the pump including an accumulator, a pump operating lever operatively linked to the accumulator, a spray head incorporated into the operating lever, an inlet communicating with the accumulator and an outlet communicating with the spray head;

a head reciprocally mounted at the top of the cane enclosing the pump;

means for filling the interior of the shaft with water;

elongated conduit means communicating between the hollow interior of the shaft and the inlet to the pump;

aperture means communicating with the pump outlet; and hollow tubular means communicating between the aperture means and the exterior of the head whereby reciprocating hand operations of the pump causes intermittent squirts of water to be emitted from the top of the cane.

2. A cane according to claim 1 including adapter means mounted between the head and the pump for transmitting reciprocal motion of the cane head to the hand pump.

3. A cane according to claim 2 wherein the adapter means includes a head portion having a predetermined configuration for receiving the pump operating lever in a motion transmitting relationship.

4. A cane according to claim 3 wherein the adapter means includes a bottom portion having a sleeve configuration, the bottom portion being secured to the head portion such that the adapter means are supported at the top of the cane by the pump operating lever.

5. A cane according to claim 4 wherein the sleeve bottom portion is of a diameter such that the upper edge of the sleeve supports the head enclosing the pump.

6. A cane according to claim 3 wherein the adapter head portion includes bosses on the exterior surface thereof for registration and interlocking with apertures in the head.

7. A cane according to claim 1 wherein the conduit means is an elongated tube extending from the pump inlet interiorly of the shaft to the base thereof.

8. A cane according to claim 1 wherein the hollow, tubular means is a semi-rigid, narrow diameter tube.

9. A cane according to claim 1 wherein the filling means is a removable cap at the base of the cane.

10. A cane according to claim 1 wherein the filling means is a removable plug situated in an aperture in the shaft located immediately below the adapter sleeve portion.

11. A cane according to claim 1 including retaining means secured to the shaft at the top thereof for holding the pump in position in the open end of the shaft.

12. A cane according to claim 11 including sealing means mounted at the top of the shaft in cooperating relationship with the pump and the retaining means whereby water in the shaft is prevented from leaking from the interior of the shaft.

* * * * *